US007481280B2

(12) United States Patent
Benge et al.

(10) Patent No.: US 7,481,280 B2
(45) Date of Patent: Jan. 27, 2009

(54) METHOD AND APPARATUS FOR CONDUCTING EARTH BOREHOLE OPERATIONS USING COILED CASING

(75) Inventors: Carl J. Benge, Hockley, TX (US); Randolph M. Charron, Calgary (CA); Thomas D. Wood, Calgary (CA)

(73) Assignee: 1243939 Alberta Ltd., Calgary (CA)

( * ) Notice: Subject to any disclaimer, the term of this patent is extended or adjusted under 35 U.S.C. 154(b) by 250 days.

(21) Appl. No.: 11/156,673

(22) Filed: Jun. 20, 2005

(65) Prior Publication Data

US 2006/0283633 A1 Dec. 21, 2006

(51) Int. Cl.
*E21B 47/00* (2006.01)
*E21B 7/00* (2006.01)

(52) U.S. Cl. ..... 175/57; 175/172; 175/171; 166/77.2; 166/384

(58) Field of Classification Search ..... 175/57, 175/171, 172, 162, 203; 166/384, 77.2
See application file for complete search history.

(56) References Cited

U.S. PATENT DOCUMENTS

| | | | | |
|---|---|---|---|---|
| 3,724,567 | A | 4/1973 | Smitherman | |
| 4,100,968 | A | 7/1978 | Delano | |
| 5,197,553 | A | 3/1993 | Leturno | |
| 5,215,151 | A * | 6/1993 | Smith et al. | 175/45 |
| 5,271,472 | A | 12/1993 | Leturno | |
| 5,291,956 | A * | 3/1994 | Mueller et al. | 175/67 |
| 5,394,951 | A * | 3/1995 | Pringle et al. | 175/61 |
| 5,547,314 | A | 8/1996 | Ames | |
| 5,641,021 | A | 6/1997 | Murray et al. | |
| 6,250,395 | B1 | 6/2001 | Torres | |
| 6,419,033 | B1 | 7/2002 | Hahn et al. | |
| 6,439,866 | B1 | 8/2002 | Farkas et al. | |
| 6,443,247 | B1 | 9/2002 | Wardly | |
| 6,502,641 | B1 * | 1/2003 | Carriere et al. | 166/384 |
| 6,513,223 | B1 | 2/2003 | Angman et al. | |
| 6,543,552 | B1 * | 4/2003 | Metcalfe et al. | 175/57 |
| 6,564,868 | B1 | 5/2003 | Ferguson et al. | |
| 6,585,052 | B2 | 7/2003 | Angman et al. | |
| 6,705,413 | B1 | 3/2004 | Tessari | |
| 6,722,451 | B2 * | 4/2004 | Saugier | 175/57 |
| 7,083,005 | B2 * | 8/2006 | Galloway et al. | 175/5 |
| 7,140,445 | B2 * | 11/2006 | Shahin et al. | 166/380 |
| 7,185,708 | B2 * | 3/2007 | Wood et al. | 166/379 |
| 2002/0029907 | A1 * | 3/2002 | Carriere et al. | 175/57 |
| 2005/0150690 | A1 * | 7/2005 | Moriarty | 175/57 |

* cited by examiner

*Primary Examiner*—Shane Bomar
(74) *Attorney, Agent, or Firm*—Browning Bushman P.C.

(57) ABSTRACT

A method and apparatus for conducting earth borehole operations include a reel (28) of continuous coiled casing (30), and an injector (20) for moving the coiled casing. The bottomhole assembly including at least a motor (54) and a bit (56) is connected to the free end of the coiled casing, and injected into the earth while circulating fluid through the coiled casing to form a drilled earth borehole having a borehole wall. The coiled casing drill string may be retrieved from the borehole, the bottomhole assembly removed, and the coiled casing again injected into the borehole, then suspended from a wellhead assembly. After severing the coiled casing, a bonding agent such as a cementitious material may be injected into the suspended coiled casing and into the annulus between the coiled casing and the borehole.

27 Claims, 9 Drawing Sheets

METHOD AND APPARATUS FOR CONDUCTING EARTH BOREHOLE OPERATIONS USING COILED CASING

FIELD OF THE INVENTION

The present invention relates to earth borehole operations such as those involving the drilling and/or lining of earth boreholes in oil and gas wells. More particularly, the present invention relates to methods and apparatus for drilling and/or lining earth boreholes using coiled casing.

BACKGROUND OF THE INVENTION

In conventional earth borehole operations such as drilling, the casing, liner, or drill string (collectively "tubular string") is made up of sections or joints of threaded tubular members, generally about 30-40 feet long, which are sequentially threaded together as the tubular string is advanced into an earth borehole. Accordingly, it is necessary for the drilling or casing running operations to be intermittently interrupted so that successive joints of tubular members can be attached, and the drilling or casing running operations continued. When threaded drill pipe or casing is employed and the next joint is ready to be attached, the drilling or casing running operations are stopped, and the tubular string in the earth borehole is suspended with slips or the like forming part of the wellhead assembly. The next joint is then stabbed into the suspended tubular string and made up, and the running operations then continued. Operations such as making and breaking threaded connections are time consuming and, more importantly, inherently dangerous to personnel on the rig floor. Furthermore, during the time when the next joint is being attached to the suspended string, fluid circulation operations involving drilling mud or casing running fluids are stopped. In conventional drilling or casing running operations using jointed tubular members, continuous circulation is thus not practical since, as noted above, during the period when a successive joint is being added, circulation operations are stopped. Continuous circulation is desirable to maintain the annulus between the casing string and the borehole clear and to prevent bridging. It is also desirable, during casing running operations, that the casing string suspended in the earth borehole be kept filled with fluid to prevent excessive fluid pressure differentials across the casing string, and thereby prevent collapse and/or blowouts.

Casing has been used as a drill string such that once the earth borehole has been drilled to the desired depth, the casing forming the drill string can be cemented in place in a conventional manner. This technique eliminates the need for separate drill strings and casing strings. Usually, when the casing string is used as the drill string, the end of the casing string in the earth borehole is attached to a disposable or retrievable bottomhole assembly which includes a motor and a drill bit. When the drilling operation is completed, the bottomhole assembly can be retrieved and the casing string in the borehole then cemented in place in a conventional manner. While drilling with casing clearly has advantages in terms of savings of time and money compared to conventional earth borehole drilling operations involving separate drill strings and casing strings, present methods for drilling with casing employ jointed casing with all the attendant problems discussed above with respect to jointed drill strings and/or casing strings.

Coiled tubing having a size of less than 3 inches or less has been uncoiled from the reel and inserted in threaded casing in a well. Although coiled tubing is not normally used in conjunction with cementing operations, it has been known to uncoil tubing from a reel into a well with a damaged casing, and then to cement the annulus between the tubing and the damaged casing in order to continue recovery from the well.

Those familiar with coiled tubing operations recognize that coiled tubing sizes conventionally extend up to about 3 inches, and that casing sizes typically extend to about 4 inches to about 7 inches or more. Coiled casing according to the present invention will thus typically have a diameter of 4 inches or more, and will commonly have a diameter of 4½ inches or 5½ inches.

U.S. Pat. No. 3,724,567 discloses a system for handling drill pipe or tubing for workover operations. The threaded tubular string may be a continuous piece moved from a storage position to the well U.S. Pat. No. 4,100,968 discloses a technique for running casing using a powered rotating tool. U.S. Pat. No. 5,197,553 discloses a retrievable bit and downhole motor at the lower end of a tubular drill stem, and U.S. Pat. No. 5,271,472 discloses a bit assembly including radially extendable and retractable arms with cutters that may be withdrawn through the drill stem.

U.S. Pat. No. 5,215,151 discloses a drilling technique with a continuous length of jointed coiled tubing. Hydraulic fluid may be pumped through the tubing string, and a wireline used to retrieve the bit. U.S. Pat. No. 5,547,314 discloses a system for storing and running jointed tubulars into a well. U.S. Pat. No. 6,250,395 discloses a system for installing and retrieving threaded pipe in a well. U.S. Pat. No. 5,641,021 discloses a well casing drill tool with closing sleeve.

U.S. Pat. No. 6,419,033 discloses a system for drilling a well with a bit and an underreamer. U.S. Pat. No. 6,439,866 discloses a downhole motor with a sealed bearing. U.S. Pat. No. 6,443,245 discloses a casing shoe. U.S. Pat. No. 6,513,223 and 6,585,052 disclose tubing centralizers. U.S. Pat. No. 6,564,868 disclose a tool and method for cutting a tubular. U.S. Pat. No. 6,705,413 discloses a technique for drilling with casing using a retrievable bit.

The prior art has not disclosed techniques for significantly reducing the cost of running casing in a well, and accordingly significant costs and risks are incurred both in running a casing in a well and in retrieving the casing string from a well.

The disadvantages of the prior art are overcome by the present invention, and improved equipment and techniques for running casing in a well is hereinafter disclosed.

SUMMARY OF THE INVENTION

In one embodiment, a method of drilling an earth borehole includes providing a reel of continuous coiled casing having a free hand, and an injector for moving the coiled casing. A bottomhole assembly including at least a downhole motor and a drill bit is connected to the free end of the continuous coiled casing to form a coiled casing drill string. A coiled casing drill string is injected into the earth while circulating fluid through the coiled casing to form a drilled earth borehole having a borehole wall. The coiled casing drill string is retrieved to the surface from the borehole, and the bottomhole assembly may be removed from the free end of the coiled casing, which may then be reinjected into the earth borehole and suspended from a wellhead assembly. The suspended coiled casing may be severed to form a suspended coiled casing string in the earth borehole, with an annulus being formed between the borehole wall and an exterior surface of the suspended coiled casing string. A cementitious material or other bonding agent may then be injected into the suspended coiled casing string and into the annulus.

In another embodiment, a retrievable bottomhole assembly is connected to the free end of the coiled casing to form a coiled casing drill string, and the earth borehole is drilled by injecting the coiled casing string into the earth while circulating fluid through the coiled casing to the bottomhole assembly. The coiled casing drill string is suspended in a wellhead assembly, and severed at a location above the suspension by the wellhead assembly. The bottomhole assembly may then be retrieved through the suspended coiled casing drill string.

In yet another embodiment, the free end of the coiled casing is connected to a disposable bottomhole assembly, and the coiled casing drill string is injected into the earth and suspended from a wellhead assembly. The coiled casing drill string is severed at a location above the suspension by the wellhead assembly, and a bonding agent injected into the suspended coiled casing drill string and about the bottomhole assembly, and upwardly into the annulus between the coiled casing drill string and the drill borehole.

In another embodiment of the invention includes an apparatus for drilling an earth borehole, including a reel of continuous coiled casing, a bottomhole assembly attached to the free end of the coiled casing and including at least a drill bit and a downhole motor, and an injector for injecting the coiled casing in the bottomhole assembly into the earth to form a drilled earth borehole with an annulus formed between the borehole wall and an exterior surface of the coiled casing. One or more pumps circulate fluid through the coiled casing and the bottomhole assembly and into the annulus between the borehole wall and the coiled casing.

In yet another embodiment, a method of installing a liner into a drilled earth borehole includes providing a reel of continuous coiled casing and an injector for moving the coiled casing. The coiled casing is injected into the drilled earth borehole, and an annulus formed between a wall of a drilled earth borehole and an exterior surface of the coiled casing injected into the drilled earth borehole. Fluid is circulated through the coiled casing as the coiled casing is injected, with the fluid passing upwardly through the annulus.

In yet another embodiment of installing a liner in an earth drilled borehole, coiled casing is injected into the drilled earth borehole while circulating fluid through the coiled casing, and the coiled casing is suspended in the borehole in a wellhead assembly. Coiled casing is severed at a length above the suspension by the wellhead assembly.

DESCRIPTION OF THE PREFERRED EMBODIMENTS

Figure 1:
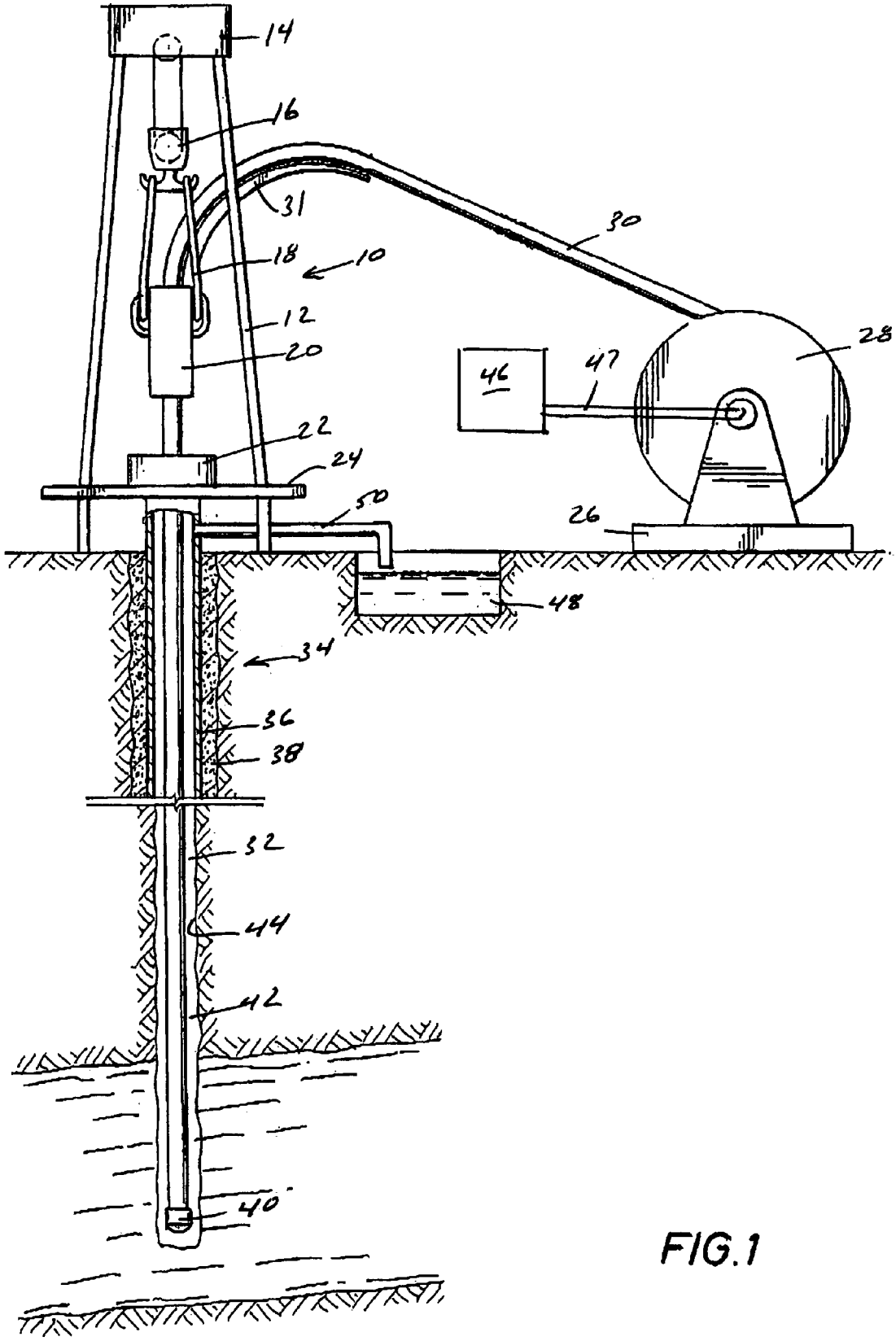
FIG. 1 is an elevational view, partially in section, showing the use of coiled casing to drill an earth borehole using a conventional drilling rig.

FIG. 1 depicts a conventional drilling rig 10 comprising a derrick 12 having a crown 14 from which is suspended a traveling block 16, traveling block 16 being attached to bails 18 which in turn suspend a coiled casing injector head 20. A typical wellhead assembly 22 is located on or adjacent the rig floor 24 and includes slips or other gripping devices for suspending tubular members in an earth borehole.

Mounted on a pad 26 is a spool 28 for housing coiled casing 30, coiled casing 30 being played off of reel 28 through an arched guide 31 into injector head 20, through wellhead 22 and then into a drilled earth borehole 32. As shown, earth borehole 32 has an upper section 34 in which has been installed surface casing 36 which is cemented in place by cement 38. As shown, the portion of the coiled casing suspended below the wellhead 22, referred to as the suspended casing string, is provided at its free end with a casing shoe 40 through which cement or other bonding agent can be pumped in a conventional fashion to cement the suspended casing string in the wellbore 32. Cementing fluid may thus pass down the casing string and up the annulus 42 between the suspended casing string and the wall 44 of the earth borehole 32. Since the coiled casing 30 is unjointed, it will be appreciated that a primary borehole liner can be continuously installed into the earth borehole 32, there being no need for intermittent stops to connect successive joints of casing as is typically done in jointed casing running operations.

A source 46 of commonly used fluids, such as brine, fresh water, drilling mud, etc., can be supplied to the coiled casing as desired through line 47 during the running operations to facilitate injection of the casing string into the borehole. The returns from annulus may be directed to mud pit 48 through line 50. In this regard, connection systems used to connect coiled tubing to such fluid suspensions can also be employed in the coiled casing operations of the present invention. When the desired length of casing string is in the borehole, the casing string may be engaged by the slips in the wellhead assembly 22 and the coiled casing severed at a location above the securing of string 30 to the wellhead 22. Thereafter, a bonding agent such as cement can be pumped down the casing string to cement the casing string in place in the borehole.

Figure 2:
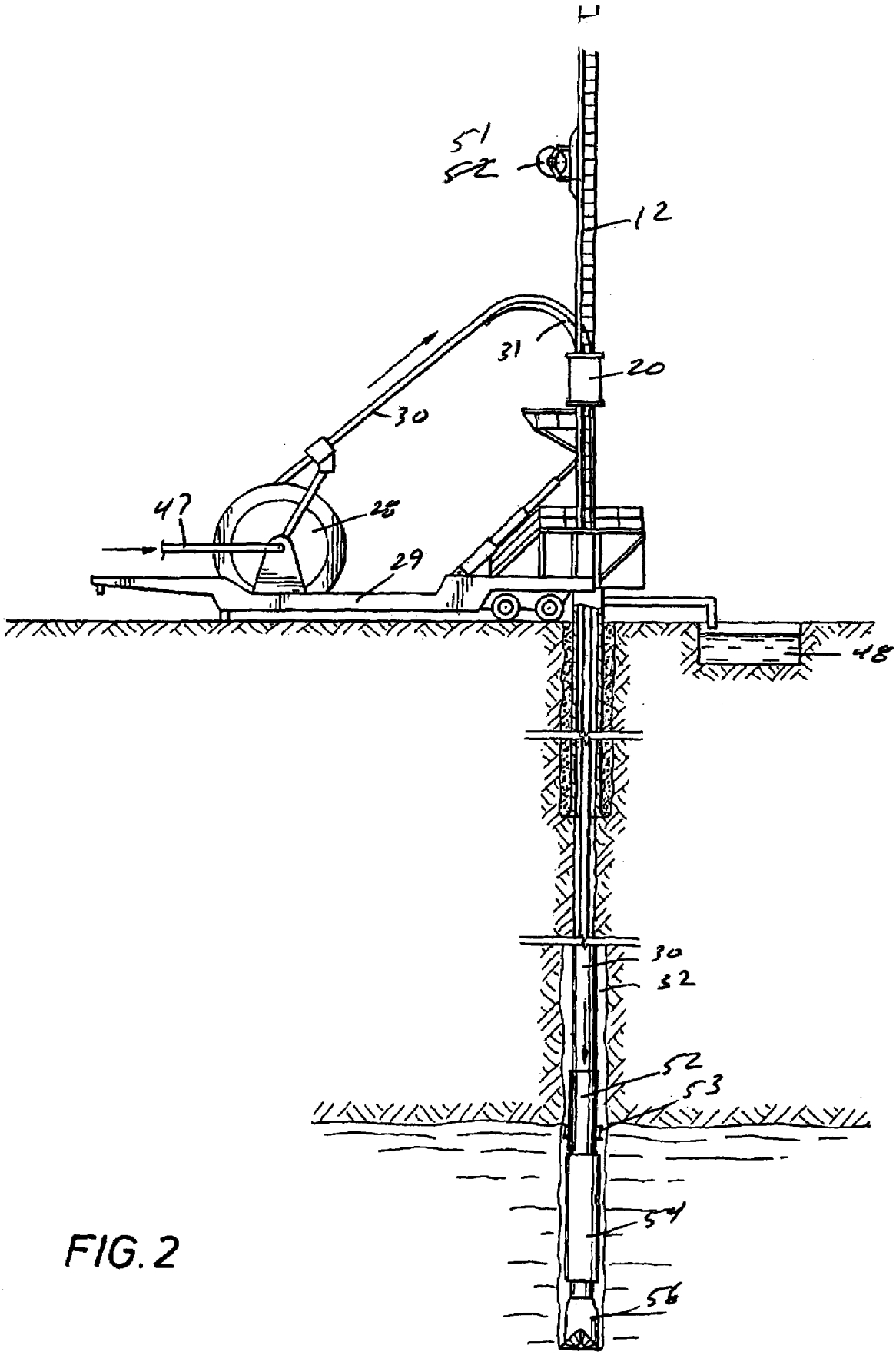
FIG. 2 is a view similar to FIG. 1, but shows the use of a trailer mounted coiled casing rig to drill an earth borehole.

FIG. 2 is similar to FIG. 1, and shows a derrick 12 suspending the injector 20, and a reel 28 supplied with fluid through line 47 while unreeling the coiled casing to the injector. A winch 51 is depicted for raising and lowering the injector 20 on the mast 12. Pit 48 receives the returns from the annulus. In this application, the coiled casing reel 28 is provided on a trailer mounted unit 29.

The lower portion of FIG. 2 is enlarged to more clearly show the annulus 32 surrounding the coiled casing 30, and also depicts a conventional mud motor 54 at the lower end of the casing string 30 for rotating the bit 56. Fluid is thus pumped through the casing string 30 by line 47, through the mud motor 54 and the bit 56, then up the annulus 42 and into the pit 48. FIG. 2 also simplistically depicts one or more drill collars 52 and one or more stabilizers 53 provided above the motor 54 for adding weight for drilling and for stabilizing the bottomhole assembly, respectively.

Figure 3:
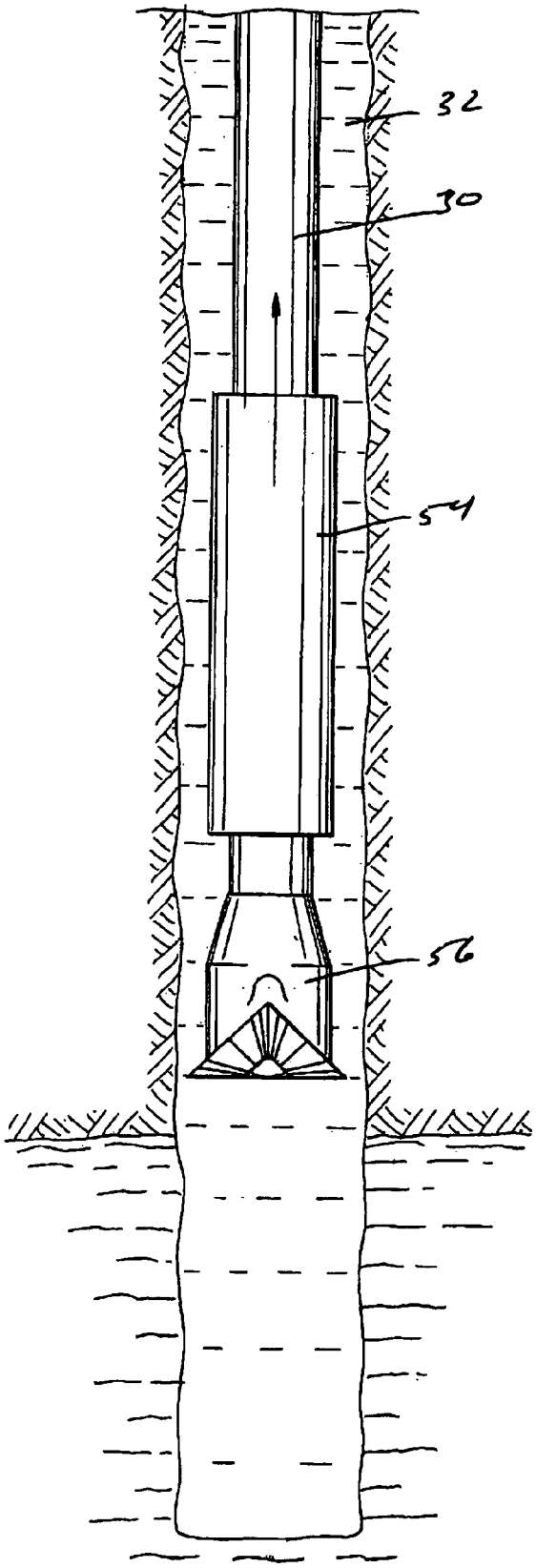
FIG. 3 is an elevational view, partially in section, showing a coiled casing bottomhole assembly being removed from a drilled earth borehole.

FIG. 3 depicts further details with respect to the lower portion of the coiled casing string 30, the mud motor 54 and the bit 56. Motor 54 may have the same diameter or a slightly larger diameter than the diameter of the coiled casing 30, so that the annulus 32 may be restricted in the area of the motor 54. The retrievable bottomhole assembly, including motor 54 and bit 52, may be periodically retrieved to the surface by powering injector 20 to move coiled casing 30 upward, thereby allowing the motor to be checked, repaired or replaced, and the bit replaced.

Figure 4:
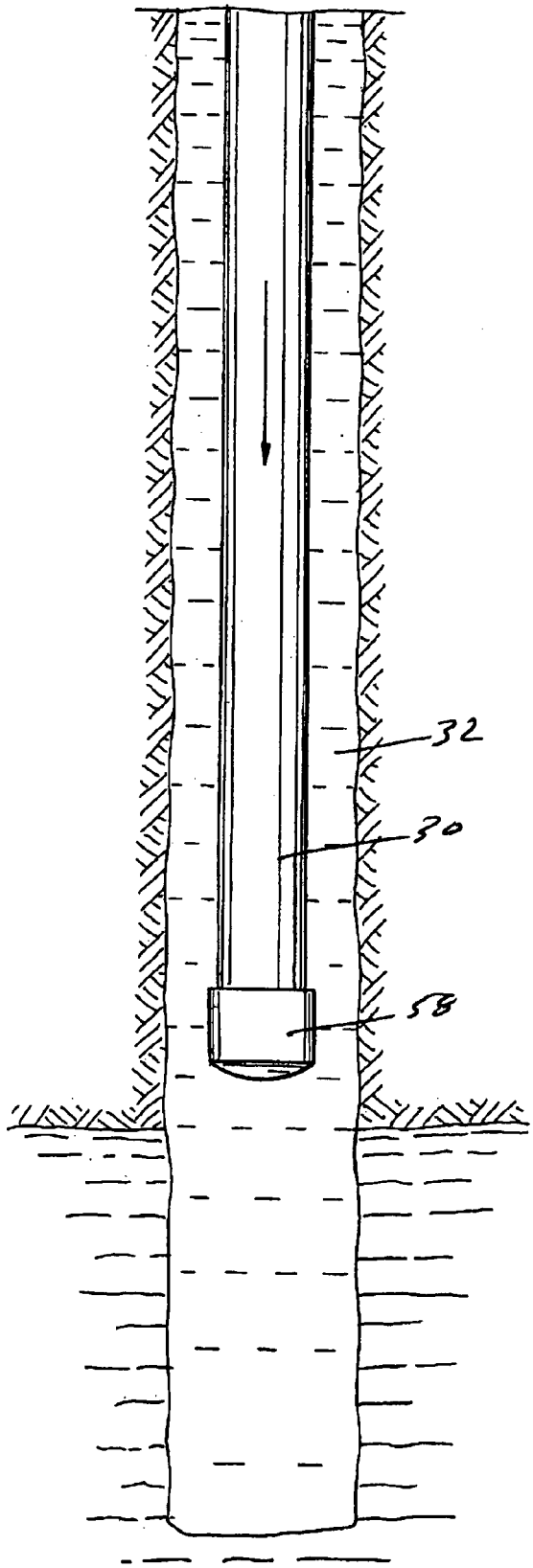
FIG. 4 is an elevational view, partially in section, showing continuous coiled casing with a cementing shoe being lowered into a drilled earth borehole.

In the FIG. 4 embodiment, the borehole 32 has been drilled to the desired depth, and the coiled casing string 30 is inserted with a conventional cementing shoe 58 provided at the lower end of the coiled casing. In an alternate embodiment, the cementing shoe may be replaced with a cementing joint.

Figure 5:
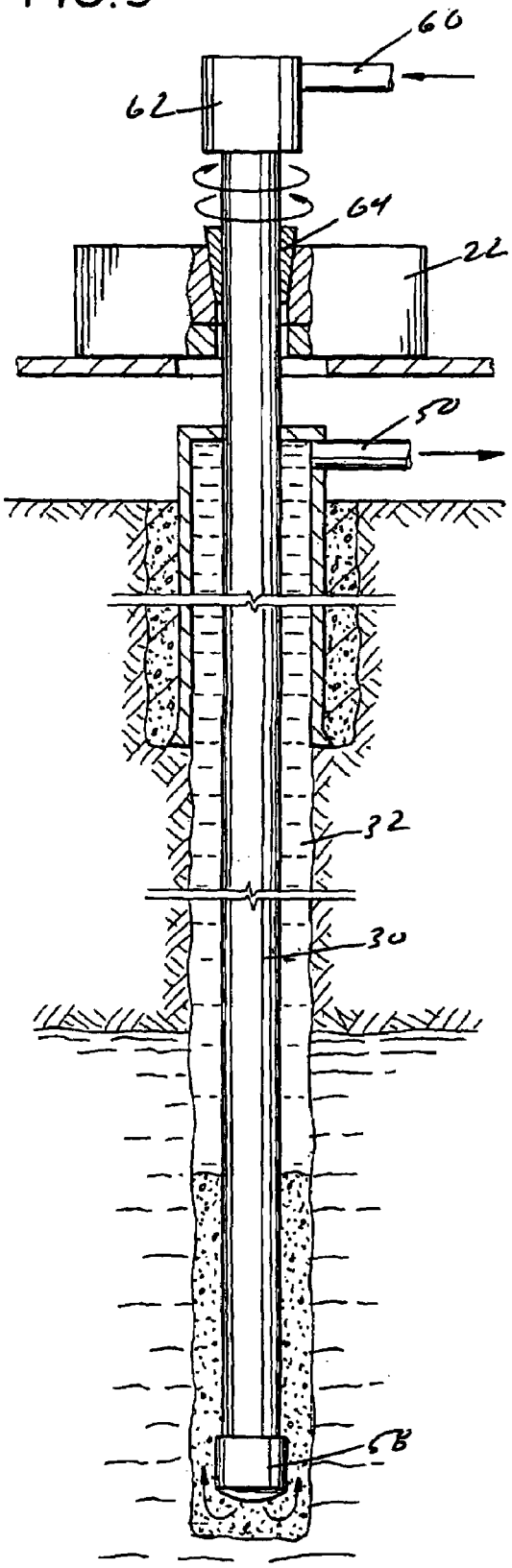
FIG. 5 is an elevational view, partially in section, showing a cementing operation wherein a casing string from coiled casing has been suspended in a drilled earth borehole and is being rotated to enhance bonding between the cement and the suspended casing string.

In the FIG. 5 embodiment, a bonding agent, such as a cementitious material, is injected through line 60 to a swivel-type cementing head 62, and from there travels downward through the coiled casing string 30 to the cementing shoe 58 at the lower end of the well. During this operation, the casing string is supported by slip 64 provided within the wellhead 22. As the hole fills with cement, fluid within the annulus 32 is driven upward and out the flowline 50 to a mud pit, as previously described. During the cementing operation, the cementing head 62 may be designed to facilitate right hand and/or left hand rotation of the coiled tubing string 30, thereby providing a more effective bond between the coiled casing string and the borehole wall.

Figure 6:
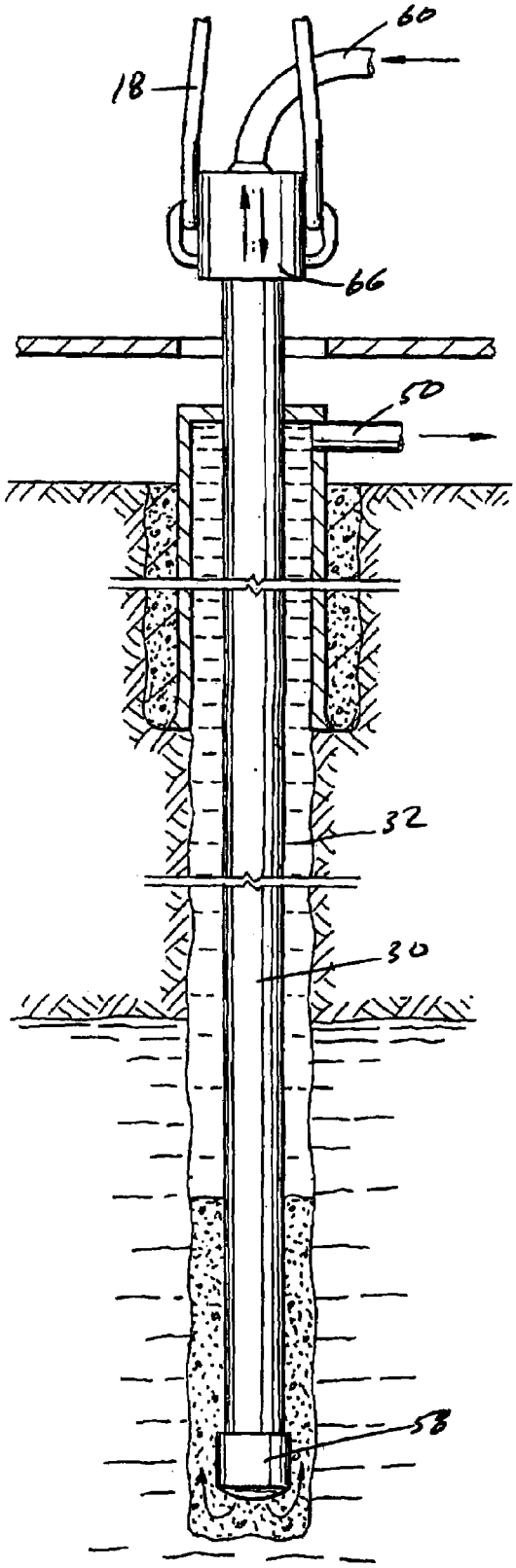
FIG. 6 is a view similar to FIG. 5 showing reciprocation for enhancing bonding between the cement and the suspended casing string.

In the FIG. 6 embodiment, an alternative cementing head 66 is suspended by bails 18, and is fed with a cementitious material through line 60. The cementing head 66 and the coiled casing string are suspended from an elevator, and are moved axially during the cementing operations. The bonding fluid is transmitted down the coiled casing 30 and out the shoe 58 at the lower end of the coiled casing string. Fluid in the annulus 32 flows by line 50 to the mud pit. For this operation, the coiled casing string preferably is reciprocated at a direction substantially aligned with the axis of the coiled casing to ensure a quality bond between the coiled casing and the borehole wall. After cementing, the tubular 30 may be suspended in a well from a wellhead, or from a casing hanger.

Figure 7:
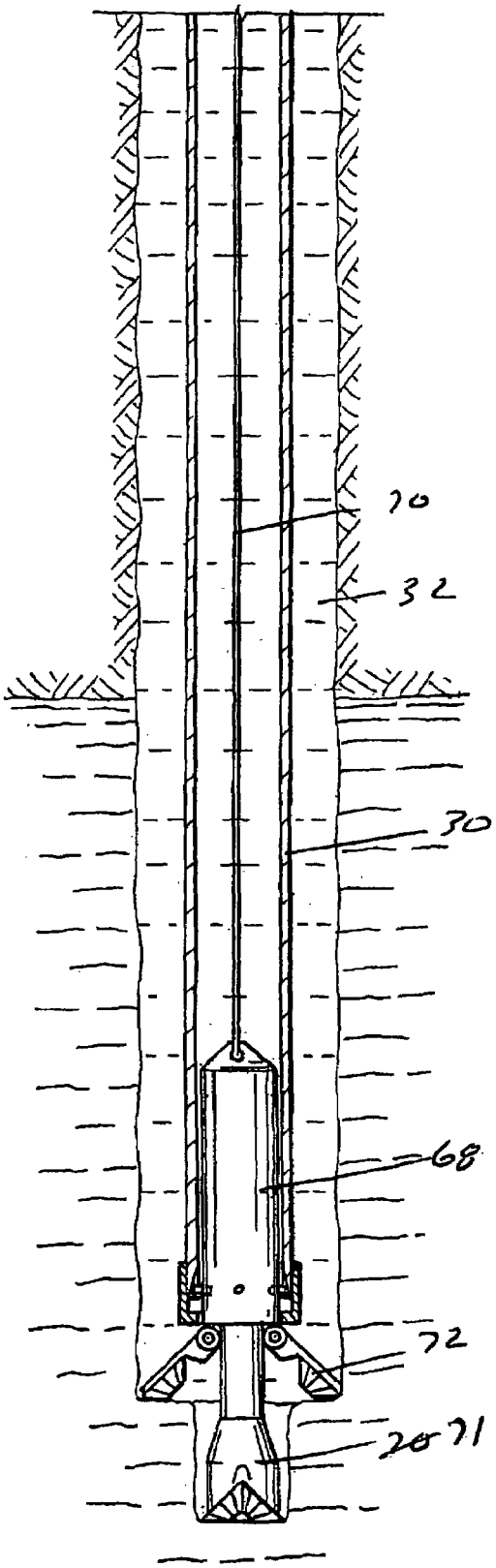
FIG. 7 is an elevational view, partially in section, showing the use of a coiled casing string as a drill string with a retrievable bottomhole assembly comprising a drill bit, an underreamer and a downhole motor attached to the end of the coiled casing string.
Figure 8:
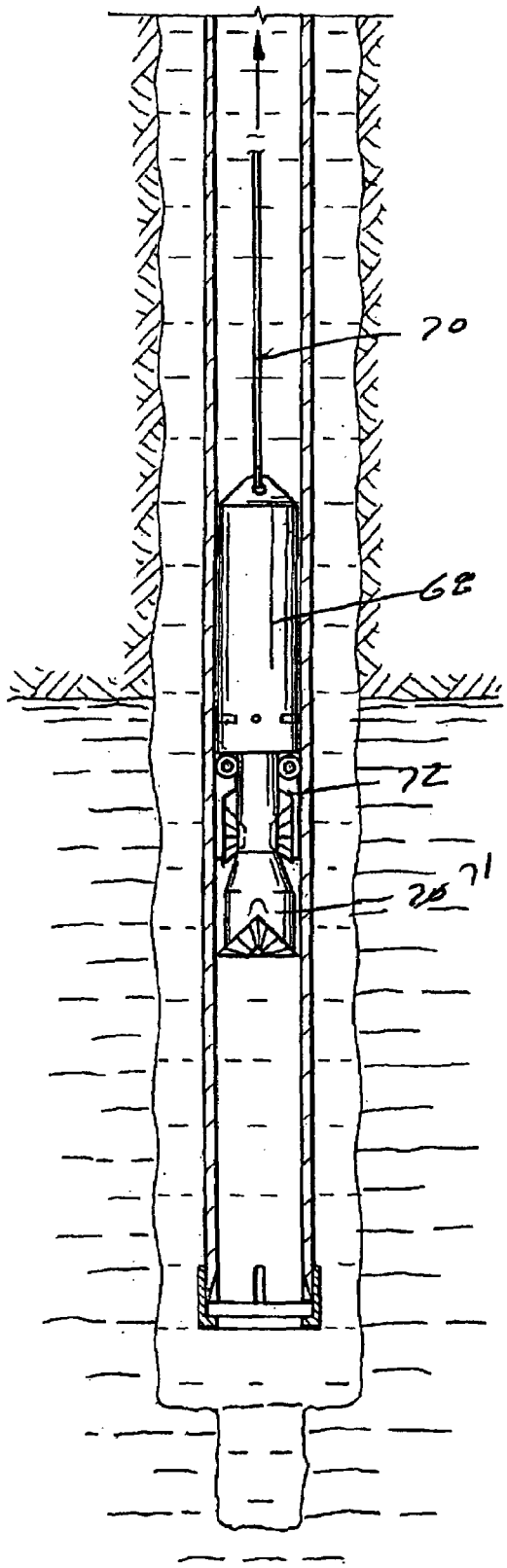
FIG. 8 shows the assembly of FIG. 7 being retrieved through the suspended string using a preinstalled retrieval line in the coiled casing.
Figure 9:
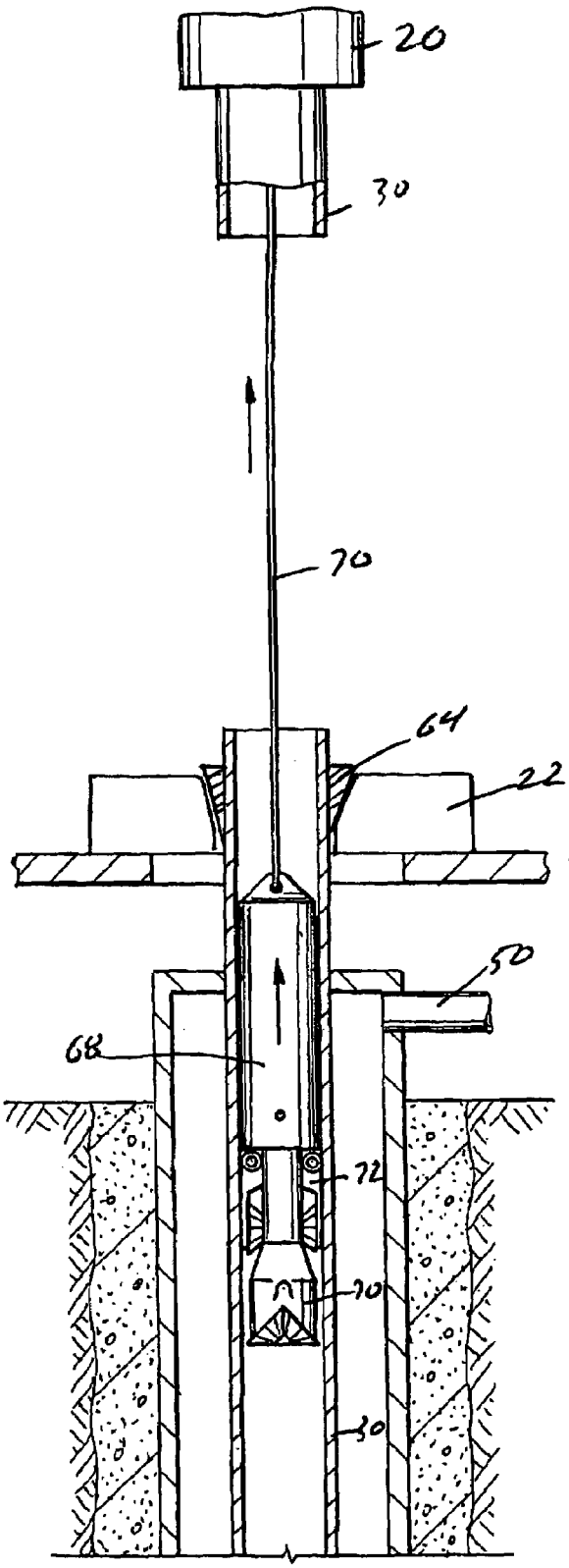
FIG. 9 shows the retrievable bottomhole assembly of FIG. 8 approaching the upper, open surface of the suspended casing string for the removal of the bottomhole assembly.

In the FIG. 7 embodiment, the retrievable mud motor 68 is suspended at the lower end of the coiled tubing from a wireline 70, which extends to the surface. The mud motor 68 rotates a pilot bit 71, and also reamer section 72 which has a cutting diameter appreciably larger than the diameter of the coiled tubing 30. Those skilled in the art will appreciate that coiled casing 30 may be left in the hole, and the mud motor 68, bit 71, and reamer 72 may be retrieved to the surface wireline 70, with the retrieved components passing through the ID of the coiled casing 30. Reamer 72 thus retract to a diameter slightly less than an internal diameter of the coiled casing, as shown in FIG. 8. FIG. 9 shows the mud motor 68, the reamer 72 and the pilot bit 71 adjacent an upper end of the casing string 30, which has been severed at a location above the slips 64 of a suitable casing hanger which fixes the coiled casing with respect to the rig floor 24. The wireline 70 may thus be retrieved through the severed coiled casing 30 and the injector 20. When retrieved to the surface, the mud motor may be repaired or replaced, and both the pilot bit and the reamer 72 replaced with new components. In an alternate embodiment, a coiled tubing string may be used instead of wireline 70 to retrieve the bottomhole assembly.

Figure 10:
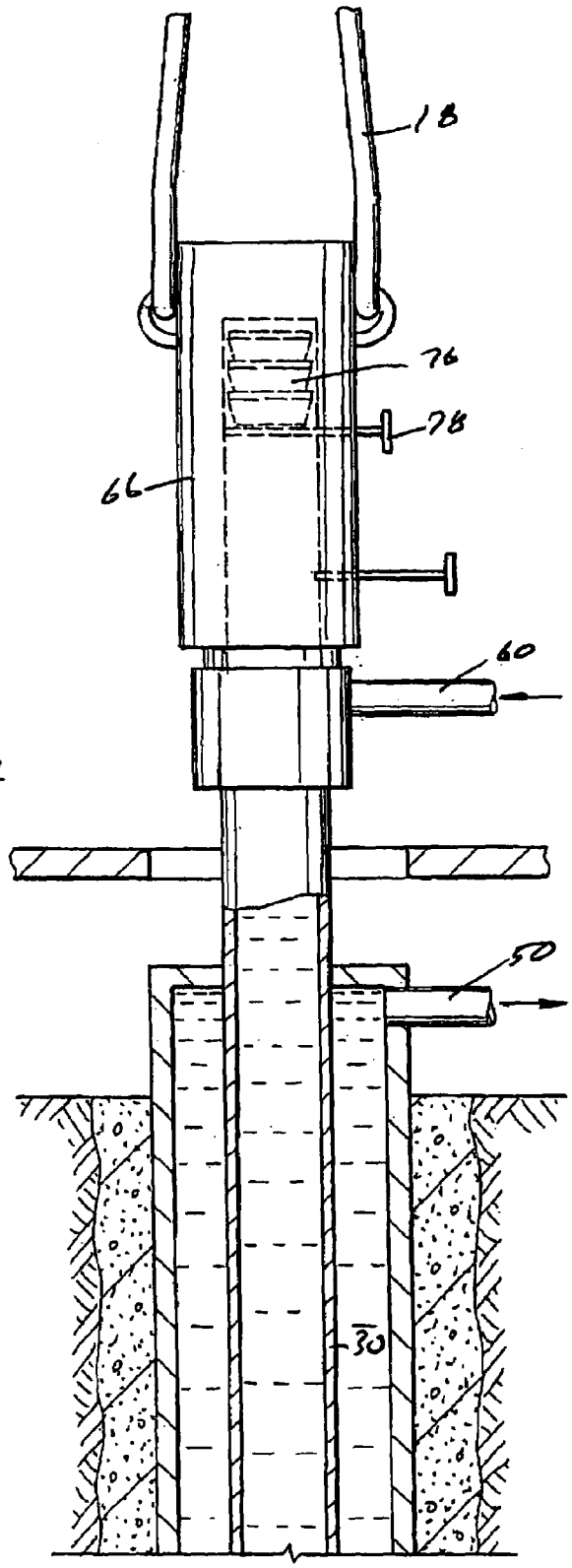
FIG. 10 is an elevational view showing the installation of a mud swivel and pig launcher on the upper end of the suspended casing string of FIG. 9.

FIG. 10 illustrates a cementing head 66 generally shown in FIG. 6, and more particularly illustrates one or more wiper plugs 76 and control members 78 for regulating the release of the wiper plugs. Cement is pumped via line 66 into the interior of the casing string 30, and fluids in the annulus flow out the line 50 to a suitable pit or other fluid retainer.

Figure 11:
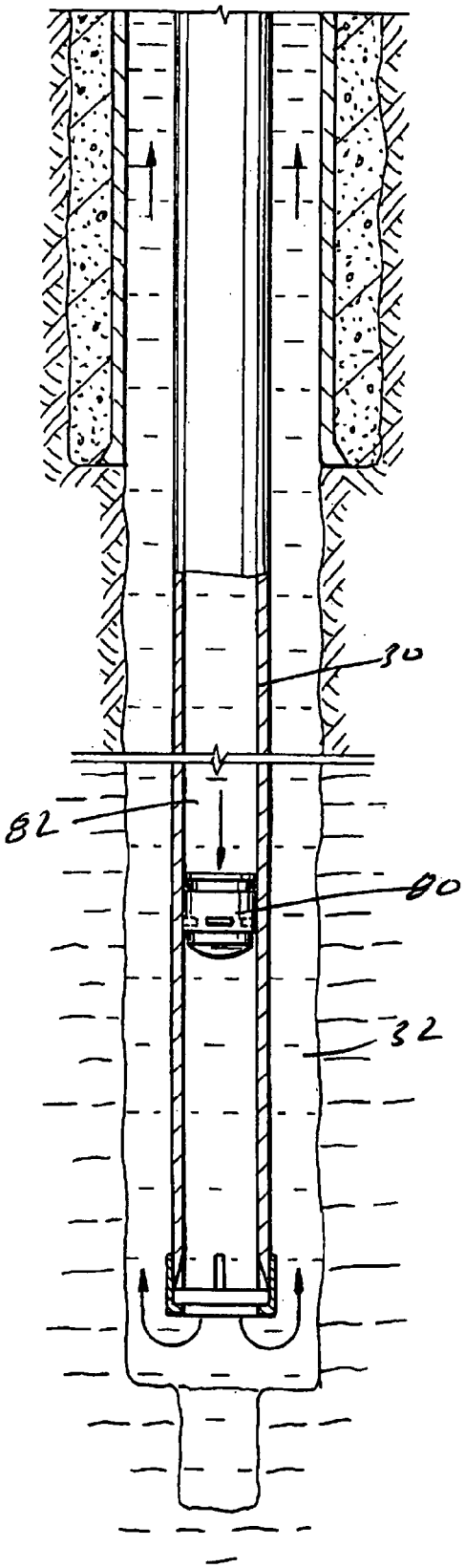
FIG. 11 shows a pump down cementing shoe which has been released from the pig launcher shown in FIG. 10.
Figure 12:
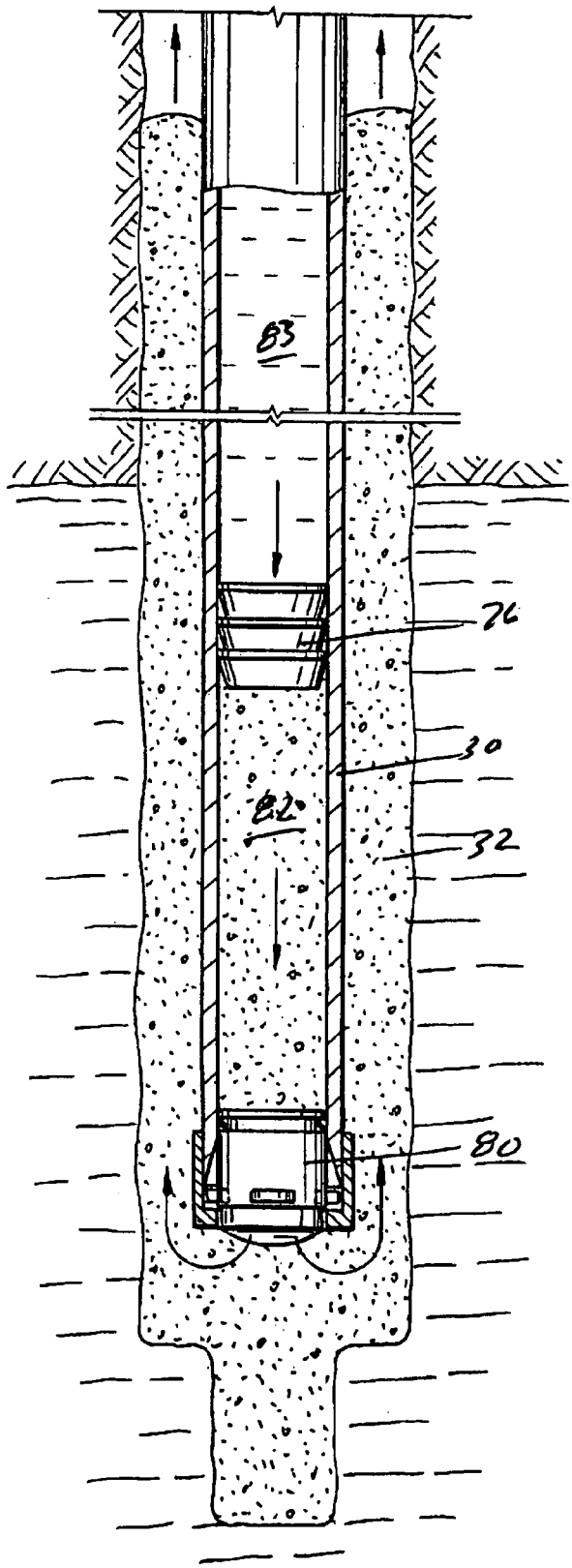
FIG. 12 is a side view showing the cementing shoe landed at the bottom of a suspended casing string and a wiper plug being pumped down to displace cement from the interior of the suspended casing string and into the annulus between the earth borehole and the casing string.

As shown in the FIGS. 11 and 12 embodiment, a pig 80 may be pumped down the coiled tubing 30 to land at the end of the coiled tubing string, with a cementitious material 82 being pumped behind the pig 80, and the upper end of the cementitious fluid being sealed from a non-cementitious driving fluid 83 by the wiper plugs 76. Fluid thus exits the bottom of the coiled casing 30, passes out of the pig 80 and into the annulus 32, filling the annulus with cement.

Figure 13:
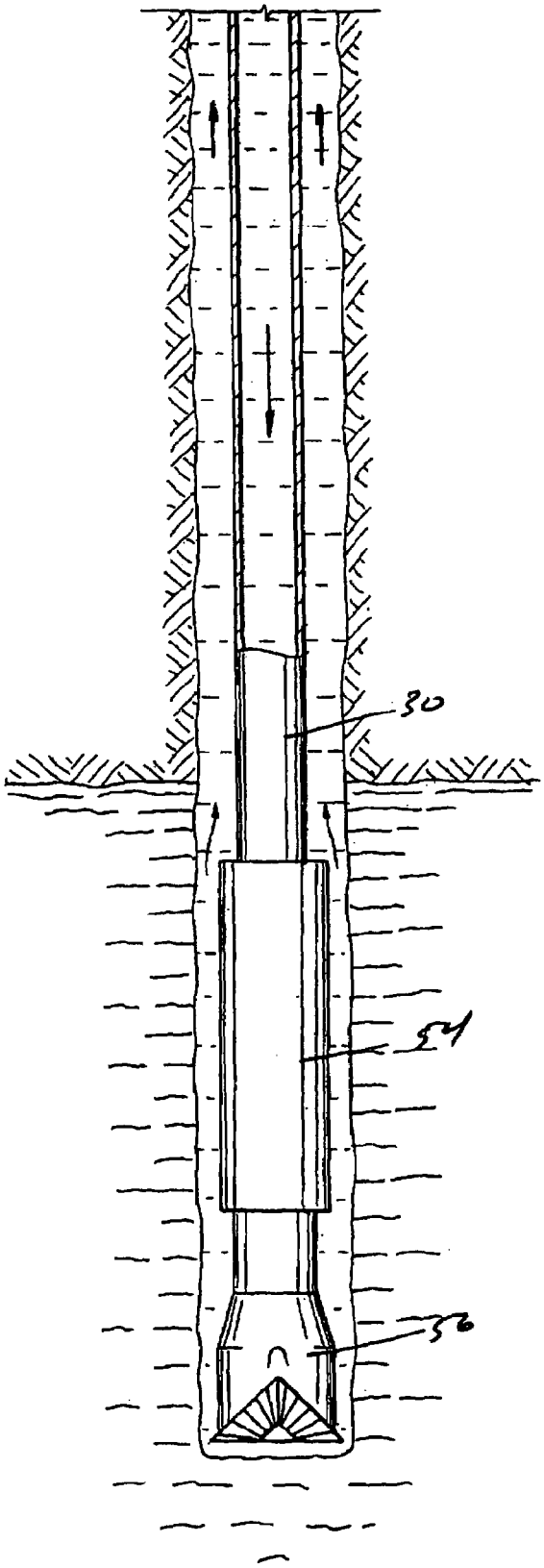
FIG. 13 depicts the drilling of an earth borehole with coiled casing using a disposable bottomhole assembly.
Figure 14:
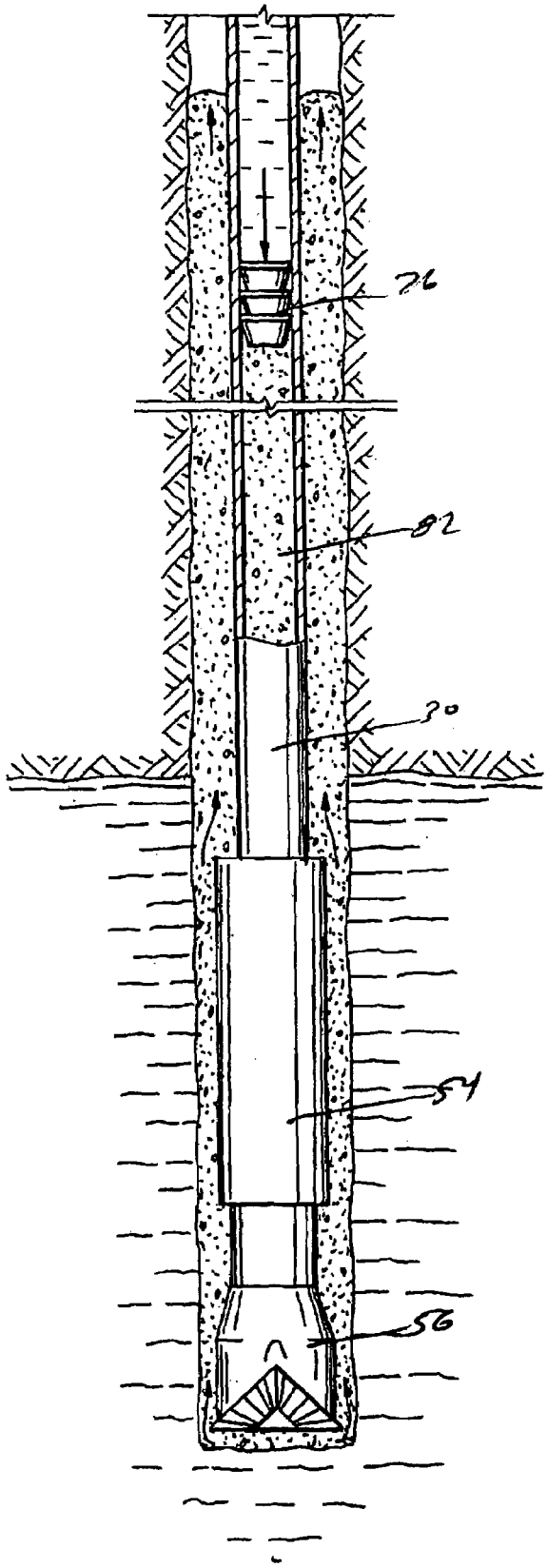
FIG. 14 shows a cementing operation through the disposable bottomhole assembly shown in FIG. 13.

In the FIG. 13 embodiment, the mud motor 54 at the lower end of the coiled casing cement 30 is powered by fluid passing downward through the coiled casing 30 and the mud motor to rotate the bit 56. For this embodiment, mud motor and bit may be an expendable item, and accordingly when the desired depth is reached, the cementitious material 82 may be pumped down the coiled casing 30, with the wiper plug 76 (see FIG. 14) serving the function previously described. The cementitious material may thus fill the annulus about the coiled casing 30, and also fill the annulus about the motor 54 and the bit 56.

Figure 15:
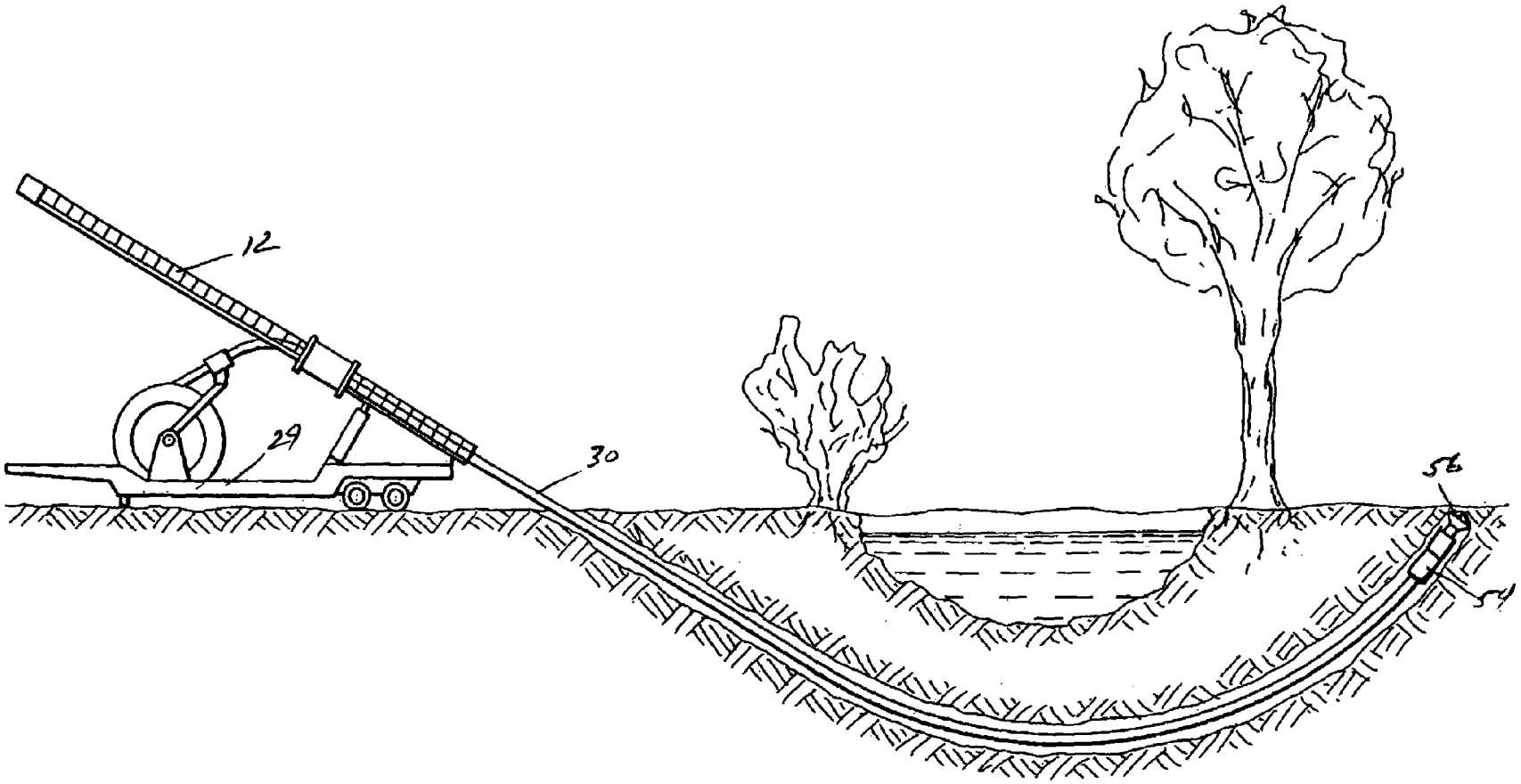
FIG. 15 shows directional drilling with coiled casing according to the present invention.

FIG. 15 discloses yet another embodiment, wherein the mast 12 is inclined relative to the trailer 29 so that the coiled casing 30 can be used to drill under a river. The motor 54 and the bit 56 may thus be provided with conventional directional drilling capability, and for this purpose the motor may include a relatively small internal bend (not shown) common for directional drilling equipment.

Circulation of fluid through the coiled tubing casing string occurs during drilling, with the circulating fluid flowing between the interior of the casing string and the annulus. Circulation when installing a liner is preferable in order to better convey the liner into the well and to provide proper hole cleaning. Circulation of a bonding agent, such as a cementitious fluid, is required if the liner is to be cemented in the open hole.

For each of the embodiments discussed herein, the coiled casing once installed in the well provides the primary barrier between the formation and the interior of the casing. Coiled casing may be perforated after it is installed, so that formation fluid will flow into the interior of the casing string. In other embodiments, the coiled casing is not a solid tubular, and instead may be slotted or perforated for preventing collapse of a formation wall while allowing fluid to flow into the interior of the casing string.

The coiled casing of the present invention may be made from various materials, including a carbon alloy steel or a carbon fiber material. Various types of guide devices, cementing stage tools, driver shoes, packers, perforating guns, correlation indicators, and cross-over tools may be used in conjunction with the coiled casing string. The bottomhole assembly may include drill collars, drill pipe, heavy weight drill pipe, shock subs, jars, hole openers, stabilizers, reamers, cross-over subs, and various types of drill bits. Whipstocks, bent subs, and various types of downhole motors with bent housings may be conveyed on the bottomhole assembly of the coiled casing string. Wellbore production tools may also be used with a coiled casing string, including side bore extensions and lateral extension placements.

The coiled casing may be drilled or conveyed into a wellbore vertically, directionally, or in a substantially horizontal plane. The techniques of the present invention may be used to recover various types of hydrocarbons, including oil and gas, and may also be used for geothermal applications, or to recover water. Applied internal pressure within the coiled casing may be produced with an energized fluid or gas. Air, nitrogen, natural gas, water, compatible liquid hydrocarbons, drilling muds, and other mediums may be used for pumping into the coiled casing string utilizing pumps or compressors common in the oilfield industry.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A method of drilling an earth borehole, comprising:

providing a reel of continuous coiled casing, said coiled casing having a free end;

providing an injector for moving said coiled casing;

connecting a bottomhole assembly including at least a downhole motor and a drill bit to said free end of said continuous coiled casing to form a coiled casing drill string;

injecting said coiled casing drill string into the earth while circulating fluid through said coiled casing to form a drilled earth borehole having a borehole wall;

retrieving said coiled casing drill string from said drilled earth borehole;

removing said bottomhole assembly from said free end of said coiled casing;

injecting said coiled casing into said drilled earth borehole to a desired depth;

suspending said injected coiled casing in said drilled earth borehole from a wellhead assembly;

severing said suspended coiled casing at a location above said suspension by said wellhead assembly to form a suspended coiled casing string in said borehole, an annulus being formed between said borehole wall and an exterior surface of said suspended coiled casing string; and injecting a bonding agent into said suspended coiled casing string and into said annulus.

2. A method as defined in claim 1, further comprising:

connecting the bottomhole assembly further including one or more drill collars with said free end of said continuous coiled casing.

3. A method as defined in claim 1, further comprising:

attaching one of a cementing shoe and a cementing joint to said free end of said coiled casing to form said coiled casing string after retrieving the coiled casing drill string from the borehole and removing the bottom hole assembly.

4. A method as defined in claim 1, wherein said injector is supported on a drilling rig.

5. A method as defined in claim 1, wherein said bonding agent is a cementitious material.

6. A method as defined in claim 1, wherein said suspended coiled casing string is moved within said drilled earth borehole during injection of said bonding agent.

7. A method of drilling an earth borehole, comprising:

providing a reel of continuous coiled casing, said coiled casing having a free end;

providing an injector for moving said coiled casing;

connecting a retrievable bottomhole assembly to said free end of said coiled casing to form a coiled casing drill string, said bottomhole assembly including at least a drill bit and a downhole motor;

drilling said earth borehole by injecting said coiled casing drill string into the earth while circulating fluid through said coiled casing to said bottomhole assembly;

suspending said coiled casing drill string in a wellhead assembly;

severing said suspended coiled casing drill string at a location above said suspension by said wellhead assembly; and retrieving said bottomhole assembly through said suspended coiled casing drill string.

8. A method as defined in claim 7, further comprising:

connecting the bottomhole assembly further including one or more drill collars and one or more stabilizers with said free end of said continuous coiled casing.

9. A method as defined in claim 7, further comprising:

attaching one of a wireline and a coiled tubing to said bottomhole assembly; and lowering said one of a wireline and a coiled tubing within said coiled casing while drilling said earth borehole.

10. A method as defined in claim 7, wherein said injector is supported on a drilling rig.

11. A method as defined in claim 7, wherein said bonding agent is a cementitious material.

12. A method as defined in claim 7, wherein said suspended coiled casing string is moved within said drilled earth borehole during injection of said bonding agent.

13. A method of drilling an earth borehole, comprising:

providing a reel of continuous coiled casing, said coiled casing having a free end;

supporting an injector on a drilling rig mast for moving said coiled casing, the supported injector being vertically movable along the mast and positionable along the mast above a wellhead assembly to position a bottomhole assembly therebetween;

connecting said free end of said coiled casing to the bottomhole assembly to form a coiled casing drill string, said bottomhole assembly including at least a downhole motor and a drill bit rotated by the downhole motor;

injecting said coiled casing drill string into the earth to form a drilled earth borehole having a wall while circulating fluid through said coiled casing to said bottomhole assembly, an annulus being formed between said wall and an exterior surface of said coiled casing drill string;

suspending said coiled casing drill string in the wellhead assembly;

severing the coiled casing drill string at a location above said suspension by the wellhead assembly; and injecting a bonding agent into the suspended coiled casing drill string about said bottomhole assembly, and upwardly into said annulus between said coiled casing drill string and said drilled earth borehole wall.

14. A method as defined in claim 13, wherein said suspended coiled casing string is moved within said drilled earth borehole during injection of said bonding agent.

15. A method as defined in claim 13, wherein said bonding agent is a cementitious material.

16. A method as defined in claim 13, further comprising:

attaching one of a cementing shoe and a cementing joint to said coiled casing prior to injecting the bonding agent.

17. An apparatus for drilling an earth borehole, comprising:

a reel of continuous coiled casing, said coiled casing having a free end;

a bottomhole assembly attached to the free end of said coiled casing, said bottomhole assembly including at least a drill bit and a downhole motor for rotating the bit;

an injector supported on and vertically moveable along a drilling rig mast for spacing the bottomhole assembly below the injector and for injecting said coiled casing and said bottomhole assembly into the earth to form a drilled earth borehole having a borehole wall, an annulus formed between said borehole wall and an exterior surface of the coiled casing; and one or more pumps for circulating fluid through said coiled casing and said bottomhole assembly and into the annulus between said borehole wall and said coiled casing.

18. An apparatus as defined in claim 17, further comprising:

one of a cementing shoe and a cementing joint attached to said coiled casing to prior to circulating fluid through said coiled casing.

19. An apparatus as defined in claim 17, wherein said circulated fluid is a cementitious material.

20. A method of installing a liner in a drilled earth borehole having a wall, comprising:

providing a reel of continuous coiled casing, said coiled casing having a free end supporting a bottomhole assembly including at least a downhole motor and a drill bit rotated by the downhole motor;

supporting an injector on a drilling rig mast for moving said coiled casing;

injecting said coiled casing into said drilled earth borehole, there being an annulus between said wall of said drilled earth borehole and an exterior surface of said coiled casing injected into said drilled earth borehole;

thereafter retrieving said bottomhole assembly from said drilled earth borehole; and circulating a fluid through said coiled casing as said coiled casing is injected, said fluid passing upwardly through said annulus.

21. A method as defined in claim 20, further comprising:

attaching one of a cementing shoe and a cementing joint to said coiled casing prior to circulating the fluid through the coiled casing.

22. A method as defined in claim 20, wherein said circulated fluid is a cementitious material.

23. A method as defined in claim 20, wherein the bottomhole assembly is retrieved through the coiled casing.

24. A method as defined in claim 20, wherein the coiled casing and the bottomhole assembly are retrieved to the surface, and the coiled casing reinjected into the well after the bottomhole assembly is removed from the coiled casing.

25. A method of installing a liner in a drilled earth borehole having a wall, comprising:

providing a reel of continuous coiled casing, said coiled casing having a free end;

supporting an injector on a drilling rig mast for moving said coiled casing, the injector being vertically moveable along the drilling rig mast;

injecting said coiled casing into said drilled earth borehole while circulating fluid through said coiled casing, there being an annulus between said borehole wall and an exterior surface of said coiled casing injected into said drilled earth borehole;

suspending said coiled casing injected into said drilled earth borehole in a wellhead assembly; and severing said coiled casing at a length above said suspension by said wellhead assembly.

26. A method as defined in claim 25, further comprising:

attaching one of a cementing shoe and a cementing joint to said coiled casing prior to circulating the fluid through the coiled casing.

27. A method as defined in claim 25, further comprising:

injecting a bonding agent into said coiled casing string and said annulus.

* * * * *